US006253396B1

(12) United States Patent
Weston

(10) Patent No.: US 6,253,396 B1
(45) Date of Patent: Jul. 3, 2001

(54) ADJUSTABLE COLLAPSING COT

(76) Inventor: Michael Munro Weston, 660 NE. 98th St., Miami Shores, FL (US) 33138

( * ) Notice: Subject to any disclaimer, the term of this patent is extended or adjusted under 35 U.S.C. 154(b) by 0 days.

(21) Appl. No.: 09/345,035

(22) Filed: Jun. 30, 1999

Related U.S. Application Data

(63) Continuation-in-part of application No. 08/916,568, filed on Aug. 22, 1997.

(51) Int. Cl.[7] ..... A61G 7/10
(52) U.S. Cl. ..... 5/110; 5/111; 5/620
(58) Field of Search ..... 5/620, 625, 626, 5/627, 110, 111, 174, 179, 618

(56) References Cited

U.S. PATENT DOCUMENTS 6,594 * 7/1849 Linikin ..... 5/618 X
189,964 * 4/1877 Stevens et al. ..... 5/618 X
4,202,062 * 5/1980 Marcyan ..... 5/618 X
4,957,121 * 9/1990 Icenogle et al. ..... 5/617 X
5,094,418 * 3/1992 McBarnes et al. ..... 248/286

* cited by examiner

*Primary Examiner*—Lynne H. Browne
*Assistant Examiner*—Fredrick Conley
(74) *Attorney, Agent, or Firm*—Malin, Haley & DiMaggio, P.A.

(57) ABSTRACT

An adjustable collapsing cot is disclosed which can be utilized in numerous situations including evacuations and military operations. The cot includes an outer frame member and an inner frame member which are both preferably divided into two sections and are both pivotable approximate their center point. Either section of the inner frame member can be adjusted to one or more elevation angles with respect to the outer frame member as desired by the user. A spring loaded webbing material is provided to safely support and cradle the user. Preferably, a mattress is provided and is disposed on top of the spring loaded webbing. One or more restraint belts can be provided to safely secure the user while he or she is utilizing the cot. Several accessories items, including an intervenes pole, message flag and miscellaneous item bag/compartment can be provided and attached to the cot. When it is desired to move the cot, the cot can be folded into an easily transportable configuration.

21 Claims, 8 Drawing Sheets

ADJUSTABLE COLLAPSING COT

This application is a continuation-in-part of U.S. application Ser. No. 08/916,568, filed Aug. 22, 1997.

BACKGROUND OF THE INVENTION

1. Field of the Invention

The present invention generally relates to cots, and particularly to a transportable cot which is adjustable and collapsible.

2. Description of the Prior Art

The number of natural disasters is increasing in alarming volumes. In 1996 alone, there was approximately 600 major natural disasters world-wide, wreaking $60 billion in damage. Each potential disaster brings the probability of need for civilian evacuation and the provision of appropriate equipment to be utilized. Far too often, older and disabled people languish in evacuation shelters on low and unstable army-type cots, or simply on the floor, because existing cots are usually unsuitable for use by the frail, injured and disabled.

Thus, what is needed in the art, is a portable cot which is easily collapsed and adjusted to meet the needs and requirements of the individual utilizing such cot. It is therefore to the effective resolution of the aforementioned problems that the present invention is directed.

SUMMARY OF THE INVENTION

The present invention provides an adjustable collapsing cot which can be utilized in numerous situations including, but not limited to evacuations and military operations. The cot includes an outer frame member and an inner frame member which are both preferably divided into two sections and are both pivotable approximate their center point. Either section of the inner frame member can be adjusted to one or more elevation angles with respect to the outer frame member as desired by the user.

Support members are preferably provided at each end the outer frame member, and are also preferably pivotable. The support members can be provided with leg members, with the bottom of the leg members being capable of having various footing configurations. A spring loaded webbing material is provided to safely support and cradle the user. Preferably, a mattress is provided and is disposed on top of the spring loaded webbing. One or more restraint belts can be provided to safely secure the user while he or she is utilizing the cot. Several accessories items, including an intervenes pole, message flag and miscellaneous item bag/compartment can be provided and attached to the cot. When it is desired to move the cot, the cot can be folded into an easily transportable configuration.

Preferably the frame members are constructed from a corrosion resistant aluminum material and the spring loaded webbing is constructed from polypropylene.

It is an object of the present invention to provide a cot which can be used in various situation, including, but not limited to military operations and civilian evacuations.

It is another object of the present invention to provide a cot which can be collapsed and be provided with multiple elevation levels.

It is a further object of the present invention to provide a collapsible cot which allows the portion of the cot adjacent a user's feet/leg area and/or the user's head/back area to be adjusted to one or more elevation angles.

It is still another object of the present invention to provide an adjustable collapsing cot which is strong, stable, durable, safe, lightweight, and portable.

It is even still another object of the present invention to provide an adjustable collapsing cot which is relatively low in cost and easy to manufacture.

It is yet another object of the present invention to provide an adjustable collapsing cot which is relatively easy to operate.

It is yet still another object of the present invention to provide an adjustable collapsing cot which is designed to meet certain needs of frail, disabled and/or injured individuals.

In accordance with these and other objects which will become apparent hereinafter, the instant invention will now be described with particular reference to the accompanying drawings.

BRIEF DESCRIPTION OF THE DRAWINGS

The invention may be better understood by reference to the drawings in which.

DESCRIPTION OF THE PREFERRED EMBODIMENTS

Figure 6:
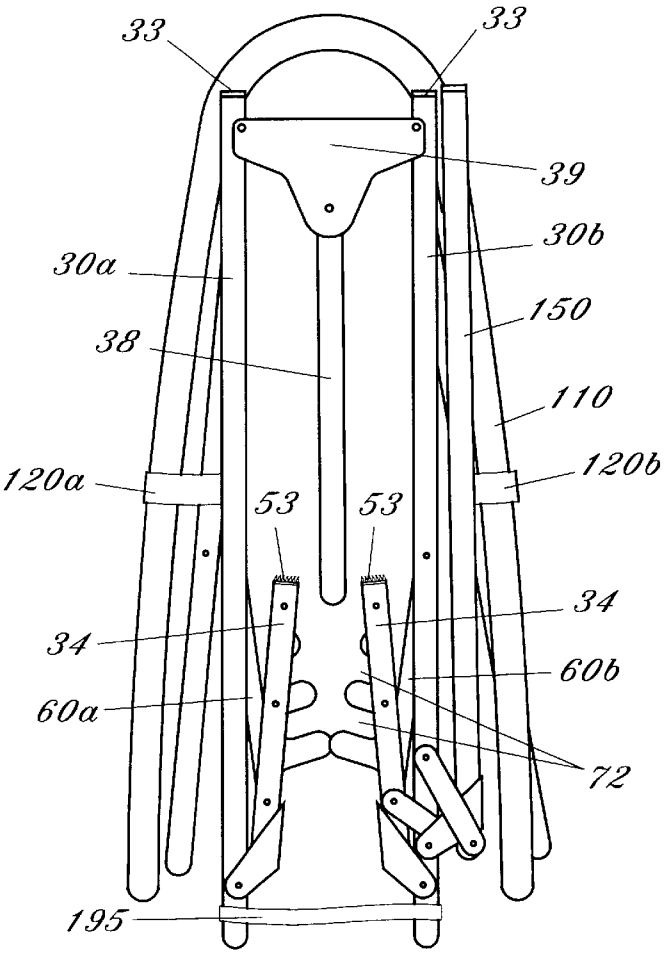
FIG. 6 is a front elevation view illustrating the present invention in a collapsed and folded position.

As seen in the drawings a portable collapsible cot is provided and generally designated as reference numeral 20. Cot 20 generally includes a frame member consisting of an outer frame portion 30 and inner frame portion 60, and a support member 90 associated with the frame member. Outer frame portion 30 is preferably rectangular in shape and includes end supports 32*a* and 32*b*, preferably pivotally attached to respective ends of outer frame portion by conventional means. Preferably, collapsible support braces 36 are provided at each corner of outer frame portion 30. End supports 32 are each provided with a pair of legs 34 for support and stability. Support braces 36 lock end supports 32, and their associated legs 34, in proper position. Legs 34 lock into place when cot 20 is properly opened. Outer frame portion 30 is preferably itself divided into two sections 30*a* and 30*b*, though such is not limiting. Ends 31*a* and 31*b* of sections 30*a* and 30*b*, respectively, are pivotally attached to a bracket member 39 by conventional means, to allow outer frame portion 30 to be collapsed/folded when not in use or for transporting, which will be discussed in further detail below. A pair of center leg members 38 can be attached to bracket 39. Ends 31*a* and 31*b*, can be provided with conventional plugs or caps 33 for safety purposes (FIG. 6).

A horizontal unshaped member 35 can be provided with each end support 32 to provide further support for cot 20. U-shaped member 35 is attached to end support 32 by conventional means such as welding, adhesives, screws, etc. and is preferably attached in an inverted "U" position adjacent the bottom of its associated end support 32. Furthermore, a horizontal support member 43 can be attached to center leg members 38 for safety and stability purposes.

Extending horizontally across from side to side of outer frame sections 30*a* and 30*b*, are positioning tubes 37*a* and 37*b*, respectively. Preferably, positioning tubes 37*a* and 37*a* are securely or permanently attached, by conventional means, to each side of outer frame sections 30*a* and 30*b*. Positioning tubes 37 are utilized, in conjunction with other components, for adjusting associated portions of inner frame member 60, which will be discussed in detail below.

Preferably, the vertical length of end supports 32 are chosen, such that the support member/mattress, discussed in detail below, is approximately eighteen (18") inches above the ground. This figure closely simulates the vertical height of a conventional bed. Thus, an individual, who may have problems moving, is able to climb onto cot 20, relatively much easier, that conventional cots which are normally only eight (8") above the ground. Where conventional cots are utilized, the individual is subject to greater chance of injury, given the ten (10") inch difference he or she is not accustomed to. The present invention eliminates this problem, by preferably providing a vertical height for cot 20 which resembles the vertical height the individual is more familiar with. However, it should be understood that the present invention is not limited to any one vertical height, and the vertical height can be chosen to any height desired, and all such height selections are considered within the scope of the invention.

Figure 4:
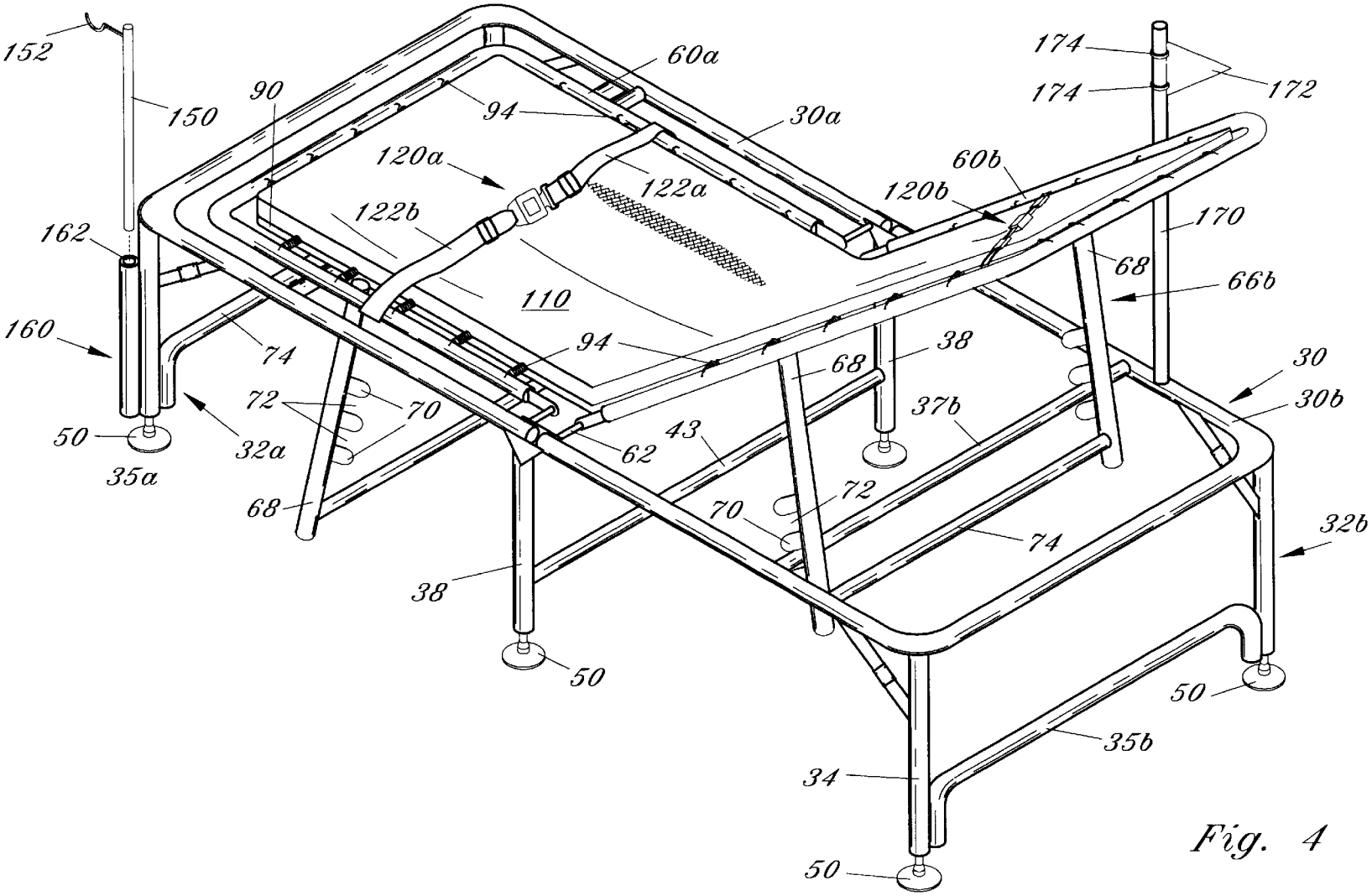
FIG. 4 is a perspective view of the present invention illustrating a first section of the inner frame member in a flat position and a second section of the inner frame member in an elevated position.
Figure 5:
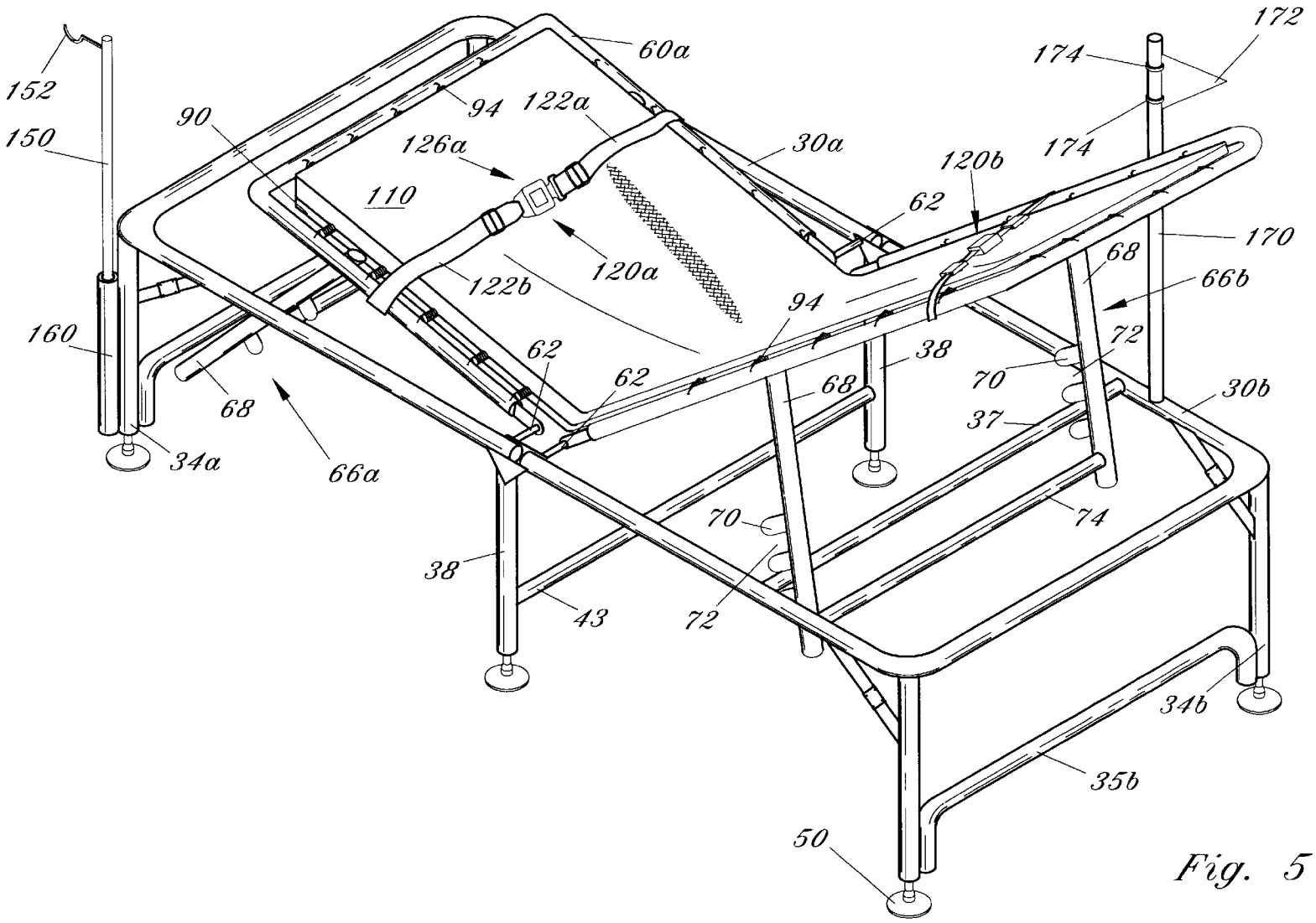
FIG. 5 is a perspective view of the present invention illustrating both the first section and the second section of the inner frame member in elevated positions, though at different elevation angles.

As seen in the various drawings, the bottom of legs 34 can be provided with various footing constructions for safety and/or travel purposes. As seen in FIG. 4, a plurality of suction cups 50, each associated with a leg 34 and/or middle support legs 38, are provided at the end of their respective legs 34 or 38 to provide for a secure attachment of cot 20 to the ground, particularly where the ground is a conventional indoor floor. Middle legs 38 can be permanently attached to respective bracket members 39 or pivotally attached by conventional means.

Figure 3:
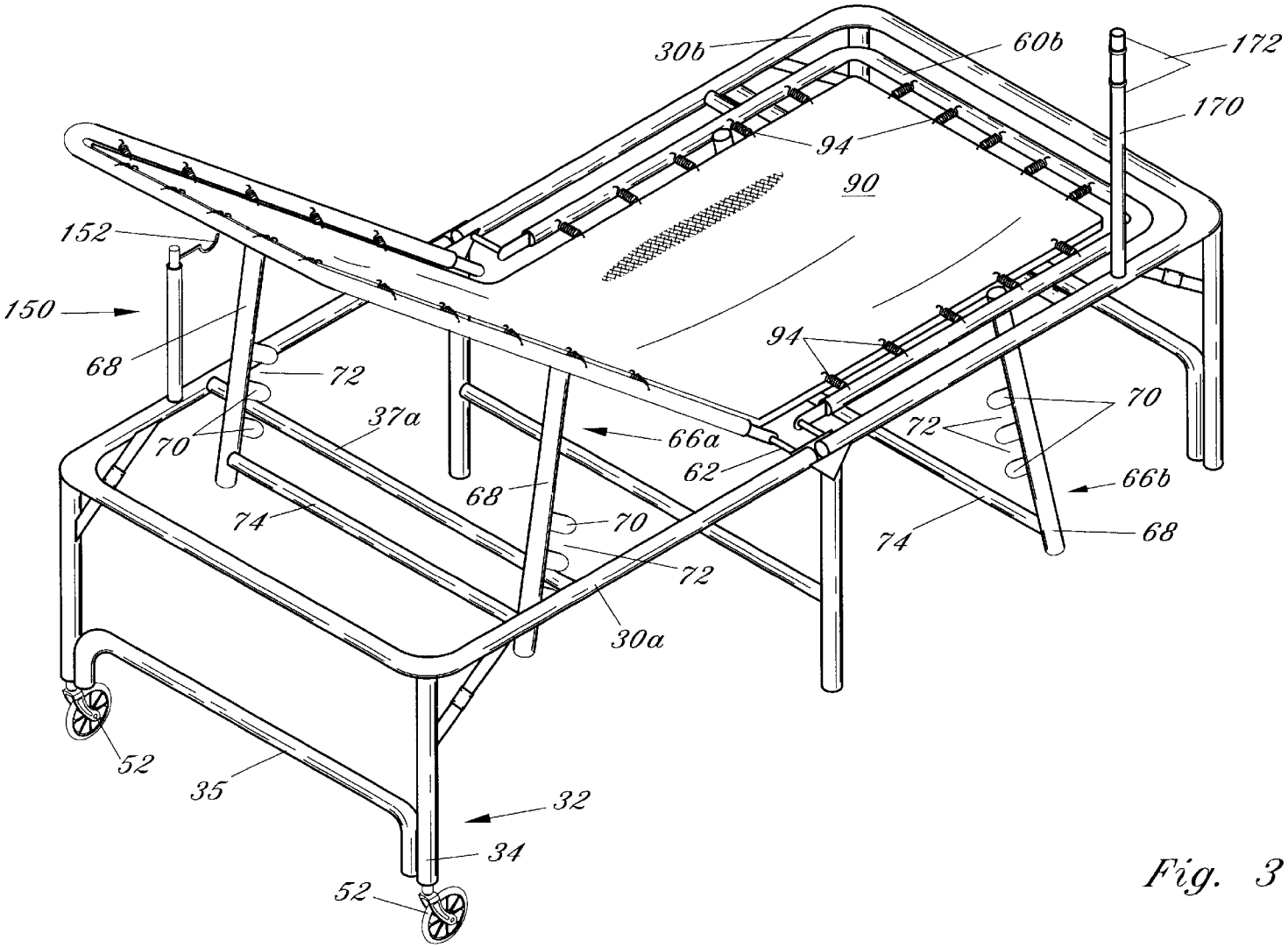
FIG. 3 is a perspective view of the present invention illustrating a first section of the inner frame member in an elevated position and a second section of the inner frame member in a flat position and with the mattress and restraint belts removed.

Alternatively, wheels 52 (FIG. 3), can be provided at the bottom of legs 34 associated with one end support 32, to make cot 20 more easily transportable. Preferably, in this embodiment only one end support 32 is provided with wheels 52 and the remaining legs 34 and legs 38 can be provided with other stop devices such as suction cups 50 discussed above, caps, plugs, spikes, and/or hook and loop fasteners, each discussed further below.

Figure 7:
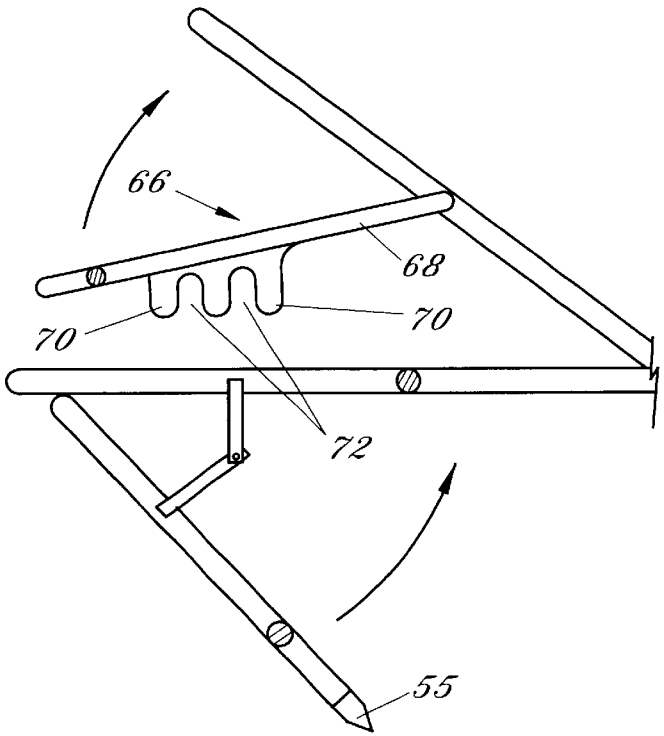
FIG. 7 is partial side elevation view illustrating the fold directions for certain components of the outer frame member and the inner frame member.

FIG. 6 illustrates the use of hook and loop fasteners 53 at the bottom of legs 38 which would mate with hook and loop fasteners positioned on the ground. Alternatively, and particularly where cot 20 is to be positioned on the grass or similar surrounding, the bottom of one or more leg members 34 and/or 38 can be provided with a spike 55 for securely mating with the surrounding area (FIG. 7). In one spike embodiment, leg 34 is extended longer in vertical length and inverted unshaped support member 35 also acts as a stop/positioning device to assure that cot 20 is at a proper vertical position. In another spike embodiment, a separate outer flange member (not shown) can be provided around legs 34 and/or 38 to act as the stop/positioning means. Lastly, conventional caps or plugs can be provided at the ends of legs 34 or 38. It should also be understood that it is also within the scope of the invention to provide nothing for leg members 34 and/or 38, with the legs themselves resting on the ground, grass, floor, etc. Furthermore, it should be understood that the various footing constructions could be used interchangeably with a single cot 20 by providing for the footings to be removable from legs 34 and/or 38. This interchangeable/removable construction is also within the scope of the invention and increases the various surfaces in which a single cot 20 can be utilized with.

Inner frame portion 60 is also preferably divided into two sections 60*a* and 60*b*, which are pivotally attached to outer frame portion 30 at bracket 39 by conventional means such as rivets 62. Attached to section 60*a* and to section 60*b*, are respective adjusting members 66*a* and 66*b*, which in conjunction with horizontal bars 37*a* and 37*b*, respectively, adjust the position of respective inner sections 60*a* and 60*b*, as desired.

Adjusting member 66 preferably consists of a pair of side members 68 which are preferably pivotally attached, adjacent their first ends, to inner frame sections 60*a* and 60*b*. However, it should be understood that the attachment of side members 68 to nner frame portion 60 is not limited to a pivot attachment, and other conventional attachment methods such as by permanent welding are considered within the scope of the invention. Side members 68 are provided with a plurality of flange members 70 which define slots 72. Slots 72 receives horizontal bars 37 when positioning one or more sections of inner frame portion 60, other than in a flat horizontal position. Where a flat horizontal position is chosen for one or both of the sections of inner frame portion 60, the associated adjusting member(s) 66 merely depends downward underneath cot 20, and inner frame section 60*a* and/or 60*b* rest upon respective horizontal bars 37*a* and/or 37*b*.

The number of flange members 70 and slots 72 chosen is not limited to those shown in the drawings and preferably is chosen to allow inner frame portion 60 to be securely adjusted to several positions, to meet the needs and desires of various individuals who may utilize cot 20 over time. A horizontal support member 74 can be attached at the outer ends of side members 68 to provide stability to side members 68.

Preferably, adjusting member 66 allows inner frame sections 60*a* and/or 60*b* to be raised to an incline of approximately forty-five (45°) degrees for support and comfort of the user. However, this forty-five (45°) degree angle should not be considered limiting, and the present invention is not limited to any one maximum degree angle. Adjusting member 66 allows for multiple elevation adjustments for inner frame sections 60*a* and 60*b* to improve comfort and ensure proper circulation for patients when medically indicated.

Attached to inner frame 60 is a flexible webbing 90 which acts as a support mat member for an individual laying on cot 20. Preferably, a relatively small rigid bar is disposed within webbing 90 around its perimeter. The rigid bar is preferably constructed from metal, steel, hard plastic, etc., though such materials should not be considered limiting. Webbing 90 is preferably attached to inner frame 60 by a plurality of springs 94. Springs 94 each include a first end which are attached along inner frame 60. A second end of each spring 94 is attached along flexible webbing 90 behind the rigid bar. The attachment of webbing 90 to frame 60 is secure and designed such that when an individual lays upon webbing 90 he or she is safely cradled towards the middle of webbing 90 to avoid tipping. Preferably, spring loaded webbing/mat 90 is constructed from a woven, stay-clean polypropylene decking. However, other similar materials which will safely support an individual intending to lay or rest on cot 20 can be utilized and are considered within the scope of the invention.

In the preferred embodiment, a mattress 110 can be provided over webbing 90 for comfort purposes and to help prevent injuries when using cot 20. Mattress 110 can consist of two (2") inch foam having a polyester ticking. However, other materials and size dimensions can be utilized and are considered within the scope of the invention.

Preferably, retaining straps 120*a* and 120*b* are provided for maintaining mattress 110 on webbing 90, as well as an individual utilizing cot 20. Strap 120*a* includes a first strap member 122*a* having a first end conventionally attached to inner frame section 60*a* and a second strap member 124*a* having a first end also conventionally attached to inner frame section 60*a*. The second ends of strap members 122*a* and 124*a* are removably connected to each other, preferably by a conventional buckle mechanism 126*a*. Buckle mechanism 126*a* includes a male insertion member 128*a* attached to the second end of strap member 122*a* and a female receiving member 130*a* attached to the second end of strap member 124*a*.

Similarly, strap 120*b* includes a first strap member 122*b* having a first end conventionally attached to inner frame section 60*b* and a second strap member 124*b* having a first end also conventionally attached to inner frame section 60*b*. The second ends of strap members 122*b* and 124*b* are removably connected to each other, preferably by a conventional buckle mechanism 126*b*. Buckle mechanism 126*b* includes a male insertion member 128*b* attached to the second end of strap member 122*b* and a female receiving member 130*b* attached to the second end of strap member 124*b*.

In operation, with the frame members properly positioned, adjusted, and locked in position, and with strap members 122*a* and 124*a* and 122*b* and 124*b* disconnected from each other, the user lays upon mattress 110, and is cradled towards the middle of mattress 110 by spring loaded webbing 90. Once properly upon mattress 110, the user or another individual connects strap members 122*a* and 124*a* to each other, via buckle mechanism 126*a*, and connects strap members 122*b* and 124*b* to each other, via buckle mechanism 126*b*. Once the strap members are connected, the user is safely restrained and secured to cot 20. By using restraint straps 120*a* and/or 120*b*, the patient has control over their domain, by being able to manipulate the buckle mechanism, insuring their safety but not being restrained contrary to their desires. Alternatively, or in addition to, restraint straps 120, conventional side rails could also be provided on the outer or inner frame.

Figure 1:
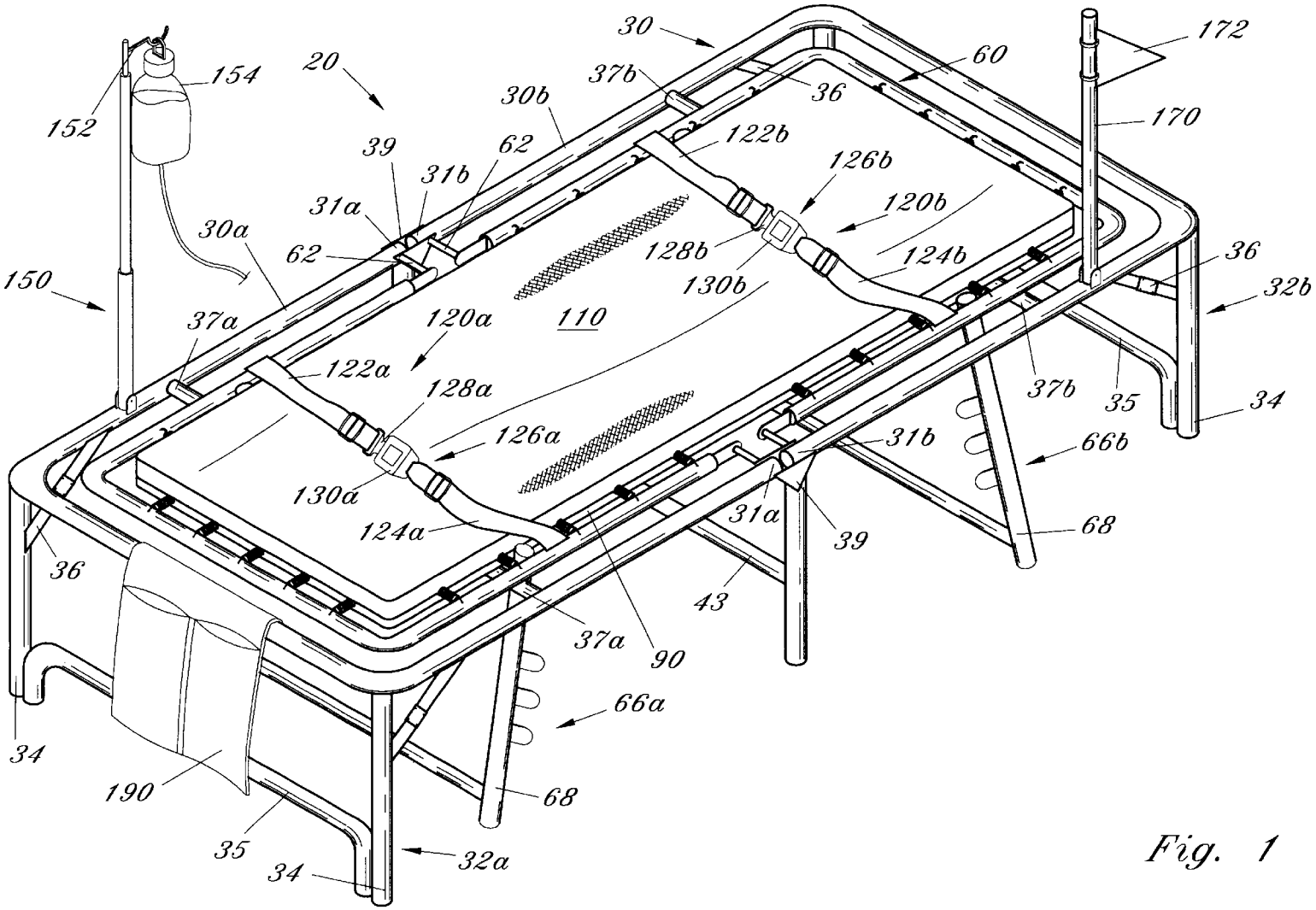
FIG. 1 is a perspective view of the present invention illustrating the inner frame member in a flat position.
Figure 2:
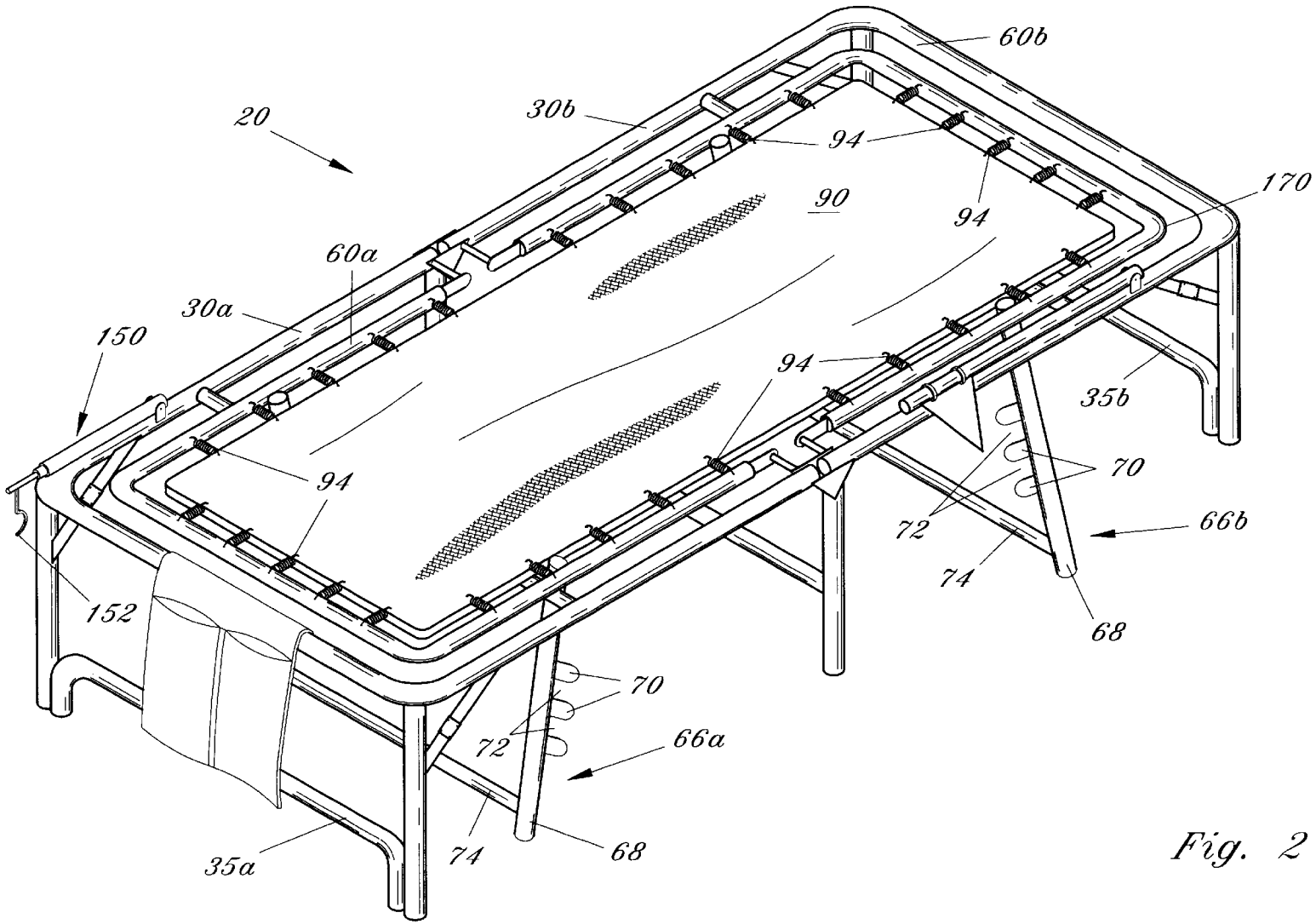
FIG. 2 is a perspective view of the present invention illustrating the inner frame member in a flat position with the mattress and restraint belts removed.

One or more accessories can be provided with cot 20. As seen in FIG. 1, an intervenes ("IV") pole 150 can be provided, and is in one embodiment pivotally attached to outer frame 30. Though not preferred, IV pole 150 could alternatively be pivotally attached to inner frame 60 and such alternative pivot attachment is also within the scope of the invention. IV pole 150 is provided with a hook member 152 for hanging a IV bag 154. Furthermore, as electricity may not be available, IV pole 150 can be telescoping in construction, to allow IV bag 154 to be positioned higher, where the liquid or medication disposed within IV bag is administered or fed by gravity. As seen in FIG. 4, in lieu of a pivot attachment, a sleeve member 160 can be attached to leg 34 or 38. Sleeve member 160 is provided with an inner diameter at least slightly larger than the outer diameter of IV pole 150. When properly positioning IV pole 150, pole 150 is inserted within an opening 162 of sleeve 160 and properly retained. A single pole or telescoping pole can be utilized with sleeve member 160.

A flag/message pole 170 can also be provided and can be attached utilizing similar attachment embodiments as described above for IV pole 150. Though not as important as IV pole 150, flag pole 170 can also be telescoping in construction, to ensure that the message or information displayed can be easily seen. A flag or other message device 172 can be attached to pole 170 by conventional means such as elastic straps 174. Flag/message 172 can by itself represent the user needs assistance, or can be provided with indicia to indicate more specifically the assistance needed by the user. Furthermore, with the sleeve attachment, a plurality of poles 170 with different messages can be provided and the user selects the pole containing or representing the message most closely matching his or her needs. Where the pivot attachment is utilized, flag/message 172 can be constructed for easy removal and replacement and a plurality of flags/messages are provided with the user selecting the flag/message containing or representing the message most closely matching his or her needs.

A flexible or rigid hanging compartment/drawer 190 can be preferably attached at one or both ends of outer frame 30. Compartment 190 can be attached by conventional means such as wrapping a top portion of compartment 190 around outer frame 30 and providing hook and loop fastening means or snaps to securely attached the top portion to the back of compartment 190. Compartment 190 can house the user's personal items including, but not limited to, medicines, prescriptions, eyeglass, hygiene items, etc. Additionally, conventional netting or webbing can also be provided underneath cot 20, and attached to frame 30 by conventional methods, for housing other items such as, but not limited to, larger items such as blankets, sheets, pillows, clothing, etc.

When transporting cot 20 it is desirable to collapse cot 20 to its folded position illustrated in FIG. 6. When collapsing cot 20, initially strap members 122*a* and 124*a* and 122*b* and 124*b* are connected to each other by respective buckle mechanisms 126*a* and 126*b*, to retain mattress 110 to frame 60 during transit. As seen in FIG. 6, IV pole 150 and flag pole 170 are either pivoted to be adjacent outer frame 30 (pivot attachment), or are removed from their insertion within associated sleeve members 160 (sleeve attachment). All other accessory items are also removed or detached from cot 20 such as compartment 190.

As seen in FIG. 7, end supports 34 are folded inward towards the remaining portion of outer frame 30, while adjusting members 66 are also folded inward towards inner frame 60. Inner frame 60 is allowed to rest upon horizontal bars 37. Outer frame sections 30*a* and 30*b* and inner frame sections 60*a* and 60*b* are folded towards each other at their respective closely adjacent pivot points. To help retain cot 20 in this collapsed configuration, a tie strap 195, or similar device, is provided. Tie strap 195 can be disposed around outer sections 30*a* and 30*b*, inner sections 60*a* and 60*b*, or both outer sections 30*a* and 30*b* and inner sections 60*a* and

60*b*. Once properly disposed the ends of tie strap 195 are attached to each other by conventional means. Once properly folded, and with or without tie strap 195, cot 20 is ready for transit.

Cot 20 is ideal for use in military operations, as well as civilian evacuations. Cot 20's versatile footing combinations make it useful in both interior and exterior terrains. Cot 20 is uniquely designed for support, strength, stability, durability and to resist tipping or collapsing. Outer frame 30 and inner frame 60 is preferably constructed from a corrosion resistant, heavy gauge, bright, one side aluminum tubing. However, this aluminum material is not limiting and other materials which achieve similar characteristics can be utilized and are considered within the scope of the invention.

Figure 8:
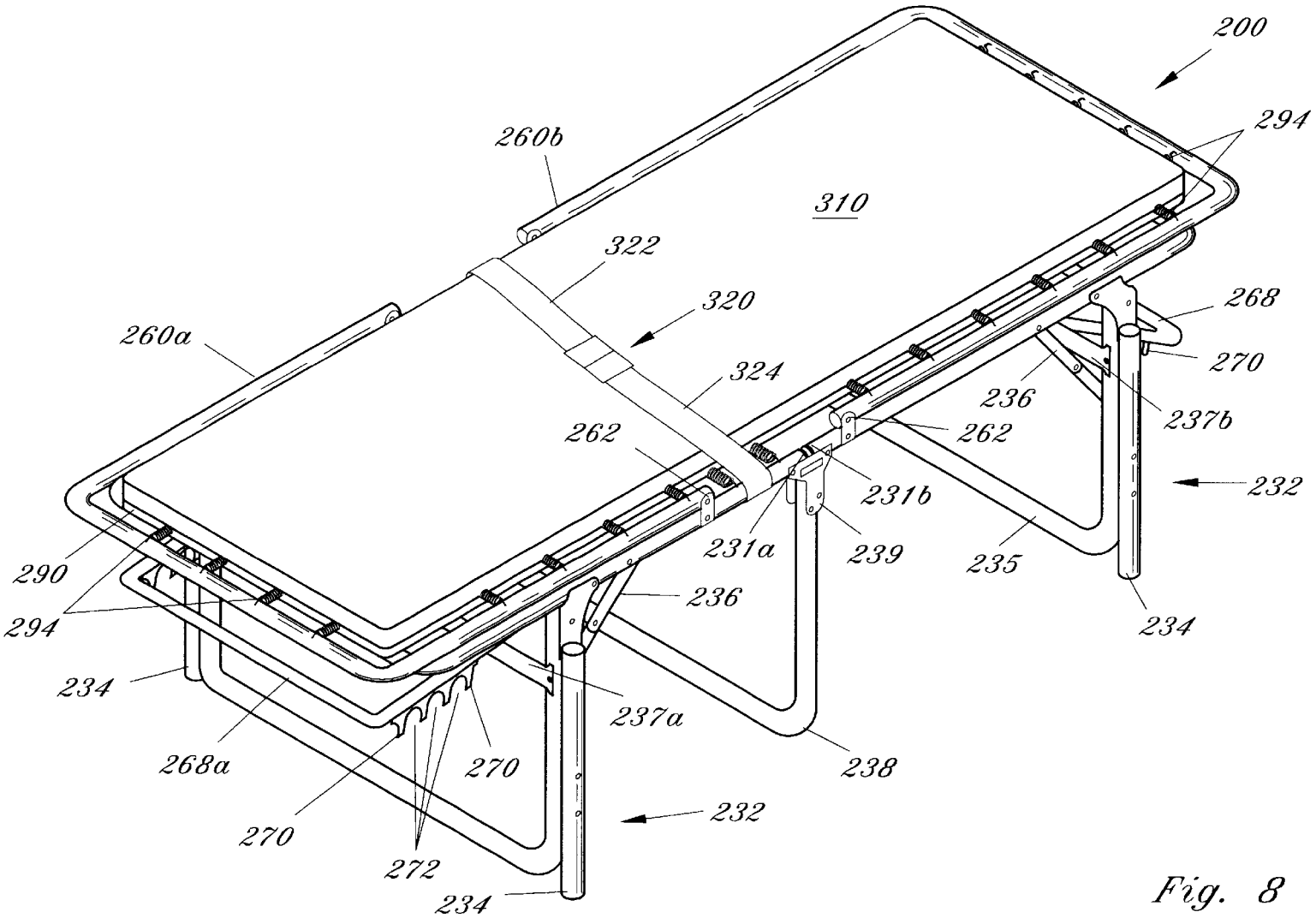
FIG. 8 is a perspective view of an alternative embodiment for the present invention.
Figure 9:
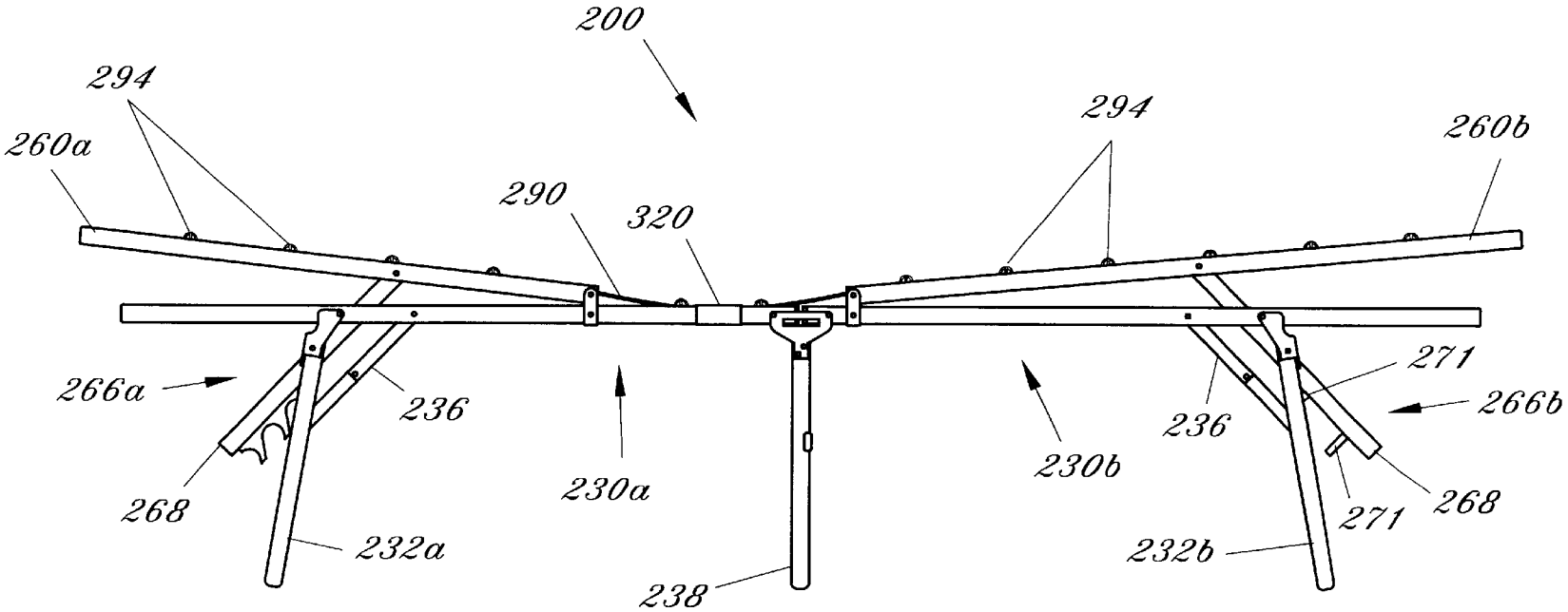
FIG. 9 is a side elevation view of the alternative embodiment shown in FIG. 8.

As seen in FIGS. 8 and 9 an alternative embodiment for the portable collapsible cot is illustrated and generally designated as reference numeral 200. Cot 200 generally includes a frame assembly consisting of a lower frame 210 and an upper frame 250, and a support member 290 associated with the frame assembly. Lower frame 210 is preferably rectangular in shape and includes frame supports 232*a* and 232*b*, preferably pivotally attached to lower frame 210 by conventional means. The exact attachment locations of supports 232 are not critical nor limiting. However, it is preferred that end portions of lower frame 210 extend beyond the attachment point of supports 232.

Preferably, collapsible support braces 236 are provided at the corner defined by the attachment of supports 232 to lower frame portion 210. Frame supports 232 are each provided with a pair of legs 234 for support and stability. Support braces 236 lock frame supports 232, and their associated legs 234, in proper position. Legs 234 lock into place when cot 200 is properly opened. Lower frame 210 is preferably itself divided into two sections 230*a* and 230*b*, though such is not limiting. Ends 231*a* and 231*b* of sections 230*a* and 230*b*, respectively, are pivotally attached to a bracket member 239 by conventional means, to allow lower frame 210 to be collapsed/folded when not in use or for transporting, which will be discussed in further detail below. A center support member 238 can be attached to bracket 239. Ends 231*a* and 231*b*, can be provided with conventional plugs or caps for safety purposes.

A U-shaped member 235 is preferably provided with each frame support 232 to provide further support for cot 200. U-shaped member 235 is attached to frame support 232 by conventional means such as welding, adhesives, screws, etc.

Extending horizontally across from side to side of and attached to U-shaped members 235, are positioning tubes 237*a* and 237*b*, respectively. Preferably, positioning tubes 237*a* and 237*b* are securely or permanently attached, by conventional means, to each side of respective U-shaped members 235. Positioning tubes 237 are utilized, in conjunction with other components, for adjusting associated portions of upper frame 250, which will be discussed in detail below.

Preferably, the vertical length of end supports 232 can bee chosen, such that the support member/mattress, discussed in detail below, is approximately fifteen (15") to twenty-five (25") inches above the ground. These figures closely simulates the vertical height of conventional beds. Thus, an individual, who may have problems moving, is able to climb onto cot 200, relatively much easier, than conventional cots which are normally only eight (8") above the ground. Where conventional cots are utilized, the individual is subject to greater chance of injury, given the relatively large difference he or she is not accustomed to. The present invention eliminates this problem, by preferably providing a vertical height for cot 200 which resembles the vertical height the individual is more familiar with. However, it should be understood that the present invention is not limited to any one vertical height, and the vertical height can be chosen to any height desired, and all such height selections are considered within the scope of the invention.

The bottom of legs 234 can be provided with various footing, fastening and/or wheel constructions for safety and/or travel purposes, similarly to those discussed above for the embodiment shown in FIGS. 1 through 7, as well as others. Center support 238 can be permanently attached to bracket members 239 or pivotally attached by conventional means.

Upper frame 250 is also preferably divided into two sections 260*a* and 260*b*, which are pivotally attached to lower frame 210 by conventional means such as brackets, rivets, etc. 262. In its down position, upper frame 250, in addition to being attached to lower frame 210, has at least a substantial portion resting upon lower frame 210 for support purposes. Though not limiting, the outer ends of sections 260 can extend beyond the ends of lower frame 210.

Attached to section 260*a* and to section 260*b*, are respective adjusting members 266*a* and 266*b*, which in conjunction with horizontal bars 237*a* and 237*b*, respectively, adjust the position of respective upper sections 260*a* and 260*b*, as desired.

Adjusting members 266 preferably consists of a unshaped positioning member 268 which is preferably pivotally attached, to respective upper frame sections 260*a* and 260*b*. However, it should be understood that the attachment of positioning members 268 is not limited to a pivot attachment, and other conventional attachment methods such as by permanent welding are considered within the scope of the invention. Positioning member 268*a* is provided with a plurality of teeth members 270 which define slots 272. Slots 272 receives horizontal bars 237*a* when positioning section 260*a* of upper frame 250, other than in a flat horizontal position. Positioning member 268*b* is provided with a plurality of pins 271 which define slots 273. Slots 273 receives horizontal bar 237*b* when positioning section 260*b* of upper frame 250, other than in a flat horizontal position.

Where a flat horizontal position is chosen for one or both of the sections of upper frame 250, the associated adjusting member(s) 266 merely depends downward underneath cot 200, and inner frame sections 260*a* and/or 260*b* rest upon respective horizontal bars 237*a* and/or 237*b*.

The number of teeth members 270, pins 271 and slots 272 or 273 chosen is not limited to those shown in the drawings and preferably is chosen to allow upper frame sections 260*a* and/or 260*b* to be securely adjusted to several positions, to meet the needs and desires of various individuals who may utilize cot 200 over time. Pins 271 are provided with one adjusting member 266 as they take up less space than teeth members 270.

Preferably, adjusting members 266 allows upper frame sections 260*a* and/or 260*b* to be raised to an incline of approximately thirty (30°) to fifty (50°) degrees for support and comfort of the user. However, these degree angles should not be considered limiting, and the present invention is not limited to any one maximum or minimum degree angle. Adjusting members 266 allows for multiple elevation adjustments for upper frame sections 260*a* and 260*b* to improve comfort and ensure proper circulation for patients when medically indicated.

As seen in FIGS. 8 and 9, sections 260*a* is attached along lower frame 210 offset a certain distance from the middle of lower frame 210, such that sections 260*a* and 260*b* do not provide an even fifty/fifty split, but rather an uneven split such as forty/sixty, thirty/seventy, etc. This uneven split helps to define a head area and a foot area for cot 200. It should be recognized that the invention is not limited to any specific split ratio.

Attached to upper frame 250 is a flexible webbing 290, which is preferably one piece and continuous, though such is not limiting, and which acts as a support member for an individual laying on cot 200. Preferably, a relatively small rigid bar is disposed within webbing 290 around its perimeter. The rigid bar is preferably constructed from metal, steel, hard plastic, etc., though such materials should not be considered limiting. Webbing 290 is preferably attached to upper frame 250 by a plurality of springs 294. Springs 294 each include a first end which are attached along upper frame 290. A second end of each spring 294 is attached along flexible webbing 290 behind the rigid bar. The attachment of webbing 290 to frame 250 is secure and designed such that when an individual lays upon webbing 290 he or she is safely cradled towards the middle of webbing 290 to avoid tipping. Preferably, spring loaded webbing/mat 290 can be constructed from a woven, stay-clean polypropylene decking. However, other similar materials which will safely support an individual intending to lay or rest on cot 200 can be utilized and are considered within the scope of the invention.

In the preferred embodiment, a mattress 310 can be provided over webbing 290 for comfort purposes and to help prevent injuries when using cot 200. Mattress 310 can consist of two (2") inch foam having a polyester ticking and can be one-piece and continuous. However, other materials and size dimensions can be utilized and are considered within the scope of the invention.

Preferably, a retaining strap 320 is provided for maintaining mattress 310 on webbing 290, as well as securing an individual using cot 200. Strap 320 includes a first strap member 322 having a first end conventionally attached to lower frame section 230*a* and a second strap member 324 having a first end also conventionally attached to lower frame section 230*a*. The second ends of strap members 322 and 324 are removably connected to each other, preferably by a conventional connector mechanism 326. Mechanism 326 can be any type of conventional buckle, seat belt connector assemblies, strap connector assemblies, etc.

In operation, with the frame members properly positioned, adjusted, and locked in position, and with strap members 322 and 324 disconnected from each other, the user lays upon mattress 310, and is cradled towards the middle of mattress 310 by spring loaded webbing 290. Once properly upon mattress 310, the user or another individual connects strap members 322 and 324 to each other, via connection mechanism 326 Once the strap members are connected, the user is safely restrained and secured to cot 200. By using restraint straps 320 the patient has control over their domain, by being able to manipulate the connection mechanism, insuring their safety but not being restrained contrary to their desires. Alternatively, or in addition to, restraint straps 320, conventional side rails could also be provided on the upper and/or lower frames. One or more accessories can be provided with cot 200, as similar to the cot embodiment shown in FIGS. 1 through 7.

When transporting cot 200 it is desirable to collapse cot 200 to its folded position, which is similar to the position illustrated in FIG. 6 for cot 20. When collapsing cot 200, initially strap members 322 and 324 can be connected to each other by connection mechanism 326, to retain mattress 310 during transit. Any accessories are either pivoted or removed, so not to interfere with the collapsing of cot 200.

Frame supports 234 can be folded inward towards of lower frame 210, while adjusting members 266 can be folded inward towards upper frame 250. Upper frame 250 can be allowed to rest upon horizontal bars 237. Lower frame sections 230*a* and 230*b* and upper frame sections 260*a* and 260*b* can be folded towards each other at their respective pivot points. To help retain cot 200 in its collapsed configuration, a tie strap or similar device can be provided, similar to tie strap 195 discussed above. Once properly folded, cot 200 is ready for transit.

Cot 200 is ideal for use in military operations, as well as civilian evacuations. Cot 200's versatile footing combinations make it useful in both interior and exterior terrains. Cot 200 is uniquely designed for support, strength, stability, durability and to resist tipping or collapsing. Lower frame 210 and/or upper frame 250 are preferably constructed from a corrosion resistant, heavy gauge, bright, one side aluminum tubing. However, this aluminum material is not limiting and other materials which achieve similar characteristics can be utilized and are considered within the scope of the invention. It should also be recognized that various structural feature(s) of one embodiment can be incorporated into or used with the other embodiment of the present invention, and vice versa.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An adjustable cot, comprising:

a lower frame having a first end and a second end;

an upper frame associated with said lower frame, said upper frame having a first portion and a second portion, said first portion of said upper frame adjustable with respect to said lower frame to one or more elevation angles, said second portion of said upper frame adjustable with respect to said lower frame to one or more elevation angles, wherein adjustment of said first portion is independent of said second portion and adjustment of said second portion is independent of said first portion;

a first end support permanently attached to the lower frame adjacent the first end of said lower frame;

a second end support permanently attached to the lower frame adjacent the second end of said lower frame; and means for supporting associated with said upper frame.

2. The adjustable cot of claim 1 wherein said means for supporting is a continuous webbing attached to said upper frame by a plurality of springs such that an individual laying upon said webbing is cradled toward a middle area of said webbing.

3. The adjustable cot of claim 1 wherein said upper frame and said lower frame are collapsible and remain connected to each other in a folded position.

4. The adjustable cot of claim 1 wherein said first portion of said upper frame is pivotally attached to said lower frame and said second portion of said upper frame is pivotally attached to said lower frame.

5. The adjustable cot of claim 1 further including a mattress disposed upon said means for supporting.

6. The adjustable cot of claim 1 further including at least one restraining strap.

7. The adjustable cot of claim 1 further including a pole attached to said lower frame.

8. The adjustable cot of claim 7 wherein said pole is adapted for hanging medications.

9. The adjustable cot of claim 7 wherein said pole is adapted for displaying messages.

10. The adjustable cot of claim 8 wherein said pole is pivotally attached to said lower frame.

11. The adjustable cot of claim 8 wherein said pole is removably attached to said lower frame.

12. The adjustable cot of claim 1 wherein said first end support is pivotally attached to said lower frame and said second end support is pivotally attached to said lower frame.

13. The adjustable cot of claim 1 wherein in a non-elevated position a first end of said first portion of said upper frame extends beyond the first end of said lower frame and a first end of said second portion of said upper frame extends beyond the second end of said lower frame.

14. An adjustable collapsing cot, comprising:

a lower frame having a first end and a second end and including a first portion and a second portion;

a first support assembly pivotally attached to the first portion of said lower frame, said first support assembly including a first positioning member;

a second support assembly pivotally attached to the second portion of said lower frame, said second support assembly including a second positioning member;

an upper frame having a first portion pivotally attached to the first portion of said lower frame, said upper frame having a second portion pivotally attached to the second portion of said lower frame;

a first adjusting member attached to said first portion of said upper frame;

a second adjusting member attached to said second portion of said upper frame;

a continuous webbing attached to said upper frame by a plurality of springs such that when an individual is placed upon said webbing he or she is cradled toward a middle area of said webbing;

a mattress disposed upon said webbing; and a restraining assembly attached to said lower frame;

wherein said first portion of said upper frame is adjustable with respect to said lower frame to one or more elevation angles by said first adjusting member and said first positioning member; wherein said second portion of said upper frame is adjustable with respect to said lower frame to one or more elevation angles by said second adjusting member and said second positioning member; wherein adjustment of said first portion is independent of said second portion and adjustment of said second portion is independent of said first portion.

15. The adjustable collapsing cot of claim 14 further including a pole attached to said lower frame, said pole adapted for hanging medication or displaying messages.

16. The adjustable cot of claim 14 wherein in a non elevated position at least a section of said first portion of said upper frame rest upon a first section of said lower frame, and wherein in a non elevated position at least a section of said second portion of said upper frame rest upon a second section of said lower frame.

17. The adjustable cot of claim 14 wherein said first portion of said upper frame is attached to said lower frame offset of a centerpoint of said lower frame.

18. The adjustable cot of claim 17 wherein in a non-elevated position at least a section of said first portion of said upper frame rest upon a first section of said lower frame and wherein in a non-elevated position at least a section of said second portion of said upper frame rest upon a second section of said lower frame; wherein said first end support is pivotally attached to said lower frame and said second end support is pivotally attached to said lower frame; wherein in a non-elevated position a first end of said first portion of said upper frame extends beyond the first end of said lower frame and a first end of said second portion of said upper frame extends beyond the second end of said lower frame.

19. An adjustable collapsing cot, comprising:

a lower frame having a first end and a second end and including a first portion and a second portion;

a first support assembly attached to the first portion of said lower frame, said first support assembly including a first positioning member;

a second support assembly attached to the second portion of said lower frame, said second support assembly including a second positioning member;

an upper frame having a first portion pivotally attached to the first portion of said lower frame, said upper frame having a second portion pivotally attached to the second portion of said lower frame;

a first adjusting member attached to said first portion of said upper frame;

a second adjusting member attached to said second portion of said upper frame;

a webbing attached to said upper frame by a plurality of springs such that when an individual is placed upon said webbing he or she is cradled toward a middle area of said webbing;

a mattress disposed upon said webbing; and a restraining assembly attached to said lower frame;

wherein said first portion of said upper frame is adjustable with respect to said lower frame to one or more elevation angles and said second portion of said upper frame is adjustable with respect to said lower frame to one or more elevation angles; wherein adjustment of said first portion is independent of said second portion and adjustment of said second portion is independent of said first portion;

wherein said first adjusting member includes a plurality of teeth which define a plurality of slots, said first positioning member disposed within a desired one of said plurality of slots which corresponds to a desired elevation for said first portion of said upper frame and a first portion of said webbing; wherein said second adjusting member includes at least one pin which define at least one slot, said second positioning member disposed within a desired slot of said second adjusting member which corresponds to a desired elevation for said second portion of said upper frame and a second portion of said webbing.

20. An adjustable cot, comprising:

a first frame having a first end and a second end;

a second frame associated with said first frame, said second frame having a first portion and a second portion, said first portion of said second frame adjustable with respect to said first frame to one or more elevation angles, said second portion of said second frame adjustable with respect to said first frame to one or more elevation angles, wherein adjustment of said first portion is independent of said second portion and adjustment of said second portion is independent of said first portion;

a first end support pivotally attached to the first frame adjacent the first end of said first frame;

a second end support pivotally attached to the first frame adjacent the second end of said first frame; and means for supporting associated with said second frame.

21. The adjustable cot of claim 20 wherein said means for supporting is a continuous webbing attached to said second frame by a plurality of springs such that an individual laying upon said webbing is cradled toward a middle area of said webbing.

* * * * *